US006072821A

United States Patent [19]

Axelsson

[11] Patent Number: 6,072,821

[45] Date of Patent: Jun. 6, 2000

[54] METHOD FOR HEAT TREATING MATERIALS AT HIGH TEMPERATURES, AND A FURNACE BOTTOM CONSTRUCTION FOR HIGH TEMPERATURE FURNACES

[75] Inventor: Niclas Axelsson, Stockholm, Sweden

[73] Assignee: Kanthal AB, Hallstahammar, Sweden

[21] Appl. No.: 09/088,919

[22] Filed: Jun. 2, 1998

[30] Foreign Application Priority Data

Jun. 3, 1997 [SE] Sweden ..... 9702104

[51] Int. Cl.[7] ..... H05B 3/60

[52] U.S. Cl. ..... 373/122; 373/118

[58] Field of Search ..... 373/122, 114, 373/119, 72, 137, 118, 109; 75/352; 432/209, 253, 262, 265; 501/108, 128; 219/390

[56] References Cited

U.S. PATENT DOCUMENTS

| | | | |
|---|---|---|---|
| 2,966,537 | 12/1960 | Witucki et al. | 373/114 |
| 3,622,135 | 11/1971 | Bauer et al. | 432/209 |
| 3,752,643 | 8/1973 | Robinson | 432/120 |
| 3,786,162 | 1/1974 | Colson | 373/119 |
| 3,844,803 | 10/1974 | Blanke et al. | 501/128 |
| 3,860,415 | 1/1975 | Gautreaux et al. | 75/352 |
| 4,383,044 | 5/1983 | Nagayama | 501/108 |
| 4,417,346 | 11/1983 | Giler | 373/137 |
| 4,654,858 | 3/1987 | Rowe | 373/72 |
| 5,539,183 | 7/1996 | Beckley | 219/386 |
| 5,835,525 | 11/1998 | Thomas | 373/137 |
| 5,946,341 | 8/1999 | Bizzari | 373/118 |

*Primary Examiner*—Teresa Walberg
*Assistant Examiner*—Quang Van
*Attorney, Agent, or Firm*—Alfred J. Mangels

[57] ABSTRACT

A method and apparatus for heat-treating a material at high temperatures wherein the material from which the bottom of a furnace chamber is made forms a eutectic with the material to be heat-treated, and does so at a temperature lower than the heat treatment temperature. A part of the furnace chamber bottom, which part can include the whole or a portion of the furnace chamber bottom, and on which the material to be heat-treated rests is formed at least in part of a material that has the same chemical composition as, or a chemical composition similar to, the chemical composition of the material to be heat-treated. The furnace bottom part on which the material to be heat-treated rests is positioned so that it has no physical contact with the remaining furnace bottom material within the furnace chamber. The furnace bottom part is positioned such that the contact location between the bottom part and the furnace lining material at which the bottom part is arranged, will assume during the heat-treatment process a temperature that is lower than the temperature at which a molten phase will be formed between the materials that are in contact with one another at the contact location.

20 Claims, 2 Drawing Sheets

METHOD FOR HEAT TREATING MATERIALS AT HIGH TEMPERATURES, AND A FURNACE BOTTOM CONSTRUCTION FOR HIGH TEMPERATURE FURNACES

BACKGROUND OF THE INVENTION

1. Field of the Invention

The present invention relates to a method for heat treating materials at high temperatures, and a furnace bottom construction for high temperature furnaces.

More specifically, the invention relates to a method and to the construction of a furnace chamber floor and furnace bottom insulation that makes possible the heat treatment of a material which is very likely to react with the material from which the furnace chamber floor is made at the heat treatment temperatures concerned.

2. Description of the Related Art

In some industrial applications, there is a need to heat-treat material at very high temperatures. At times, it is necessary to heat-treat material at temperatures close to their melting points.

The diffusion coefficient of some substances is very high at such high temperatures. This means that atoms from an object A that consists to 100% of the material A that is being heat-treated will diffuse into underlying material B that consists to 100% of the material B, which may be a furnace bottom or a crucible that forms the furnace bottom and that is intended to receive the material to be heat-treated. The material B will, of course, also diffuse into the material A. The maximum temperature that can be used in the heat treatment process is limited by the temperature at which said materials first begin to form a smelt.

Monocrystalline and polycrystalline oxidic material such as aluminium oxide and other aluminium-oxide based materials, such as YAG, i.e. $3Y_2O_3 * 5Al_2O_3$ or $TiO_2$, are examples of materials that it is desirable to heat-treat at temperatures very close to their melting points.

A common feature of these materials is that they have a very high melting point when in very pure states. One furnace alternative for heat-treating such materials are furnaces that are heated by means of electrical resistance elements of zirconium dioxide, these furnaces also being the only alternative when the heat treatment shall be carried out in an oxidizing atmosphere. Furnaces based on zirconium-dioxide elements are described in U.S. Pat. Nos. 4,041,236 and 3,440,322, and also in Swedish Patent Specification 9502475-8. When the furnaces are constructed as box furnaces or elevator furnaces, the floor of the furnace chamber will be made of the same material as the walls and ceiling or roof of the chamber, which may be zirconium dioxide, magnesium oxide, calcium oxide or some other oxidic material, or a combination of oxidic materials.

With the view of highlighting the problems that exist, it is assumed that aluminium oxide shall be heat-treated at 2000° C. In this regard, $Al_2O_3$—MgO forms a eutectic at 1995° C., CaO—$Al_2O_3$ forms a eutectic at about 1600° C., and $ZrO_2$—$Al_2O_3$ forms a eutectic at 1845° C. None of these material combinations can therefore be used to heat-treat aluminium oxide at 2000° C.

The present invention solves this problem and enables heat treatment to be carried out at temperatures higher than the temperature at which a eutectic is formed between the material to be heat-treated and the material from which the floor of the furnace chamber is made.

SUMMARY OF THE INVENTION

The present invention thus relates to a method of heat-treating material at high temperatures where the material from which the bottom of the furnace chamber is made forms a eutectic with the material to be heat-treated at a temperature that is lower than the heat treatment temperature. A part of the furnace-chamber bottom on which the material to be heat-treated rests, said part including the whole of said bottom or a portion thereof, is formed at least in part of a material that has the same chemical composition as or a similar chemical composition to the material to be heat-treated. The furnace-chamber bottom part has no physical contact with the rest of the furnace chamber lining. The furnace chamber bottom part construction at a position at which the contact location between said bottom part and the furnace lining material, at which said bottom part is disposed has, during said heat treatment process a temperature which is lower than the temperature required to form a molten phase between those materials that are in mutual contact at said contact location.

The invention also relates to a furnace bottom construction wherein a portion thereof is made from a material that is formed at least in part from a material that has the same chemical composition as or a similar chemical composition to a material to be heat-treated, and is spaced from the furnace chamber lining.

BRIEF DESCRIPTION OF THE DRAWINGS

The invention will now be described in more detail with reference to exemplifying embodiments thereof and also with reference to the accompanying drawings, together with the graph, where.

DESCRIPTION OF THE PREFERRED EMBODIMENTS

Figure 1:
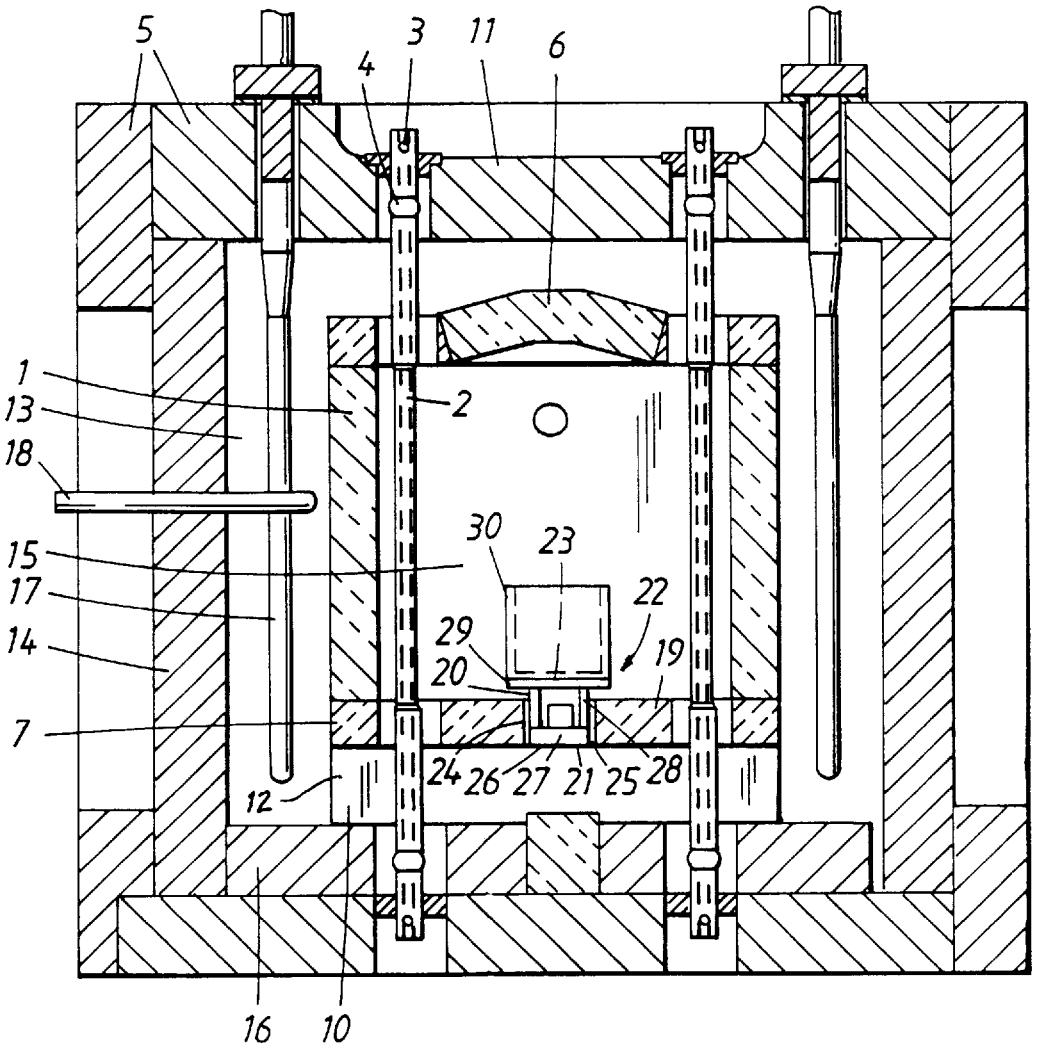
FIG. 1 is a schematic, vertical sectioned view of a furnace according to a first embodiment in which the invention is applied.

The basic construction of the furnace shown in FIG. 1 is described in more detail in Swedish Patent Specification 9502475-8. The furnace includes an inner furnace chamber 15 and an outer furnace chamber 13. The inner furnace chamber is delimited by a roof or ceiling 6, a bottom 7, and side walls 1. The side walls, roof and bottom are ideally made of ceramic material, preferably stabilized zirconium dioxide. The inner furnace chamber 15 rests on beams and columns 10 of zirconium dioxide material 10. The inner furnace chamber 15 is also supported at its four corners by aluminium oxide corner posts 12. The roof 6 and the bottom 7 of the inner furnace chamber 15 include holes through which lead-ins 3 pass to zirconium dioxide elements whose glow zones 2 are located in the inner furnace chamber. The leads-ins 3 are made of the same material as the glow zones 2, i.e. zirconium dioxide stabilized with yttrium oxide, while platinum/rhodium wires 4 are provided for conducting electrical energy. The wires 4 are wound around the lead-ins 3 at the place where said lead-ins pass through the roof 11 of the outer furnace chamber 13, and the wires 4 extend from there out of the furnace. The outer furnace chamber 13 is delimited by a self-supporting roof 11, a bottom 16 and walls 14.

The walls delimiting the outer furnace chamber to the surroundings are comprised of one of the materials aluminium oxide brick and aluminium oxide fibre material.

Located in the outer furnace chamber 13 are resistance elements 17, which preferably consist of a molybdenum disilicide material. The lead-ins leading to these elements extend out through the roof 11 of the outer furnace chamber 13 and are typically U-shaped.

Arranged in the outer furnace chamber 13 is a thermoelement 18 for sensing the temperature of the outer furnace chamber. This thermoelement is used to regulate the temperature in the outer furnace chamber. The temperature of the inner furnace chamber is regulated with the aid of an optical pyrometer which measures the temperature with the aid of a fibre optic (not shown).

The outside of the outer furnace is insulated with fiber material 5. The furnace opening consists in an outer door and an inner door. A furnace of this description is a box-like furnace. The furnace construction is also appropriate for an elevator furnace, when the furnace opening is moved to the bottom of the furnace. The aforedescribed furnace is a suitable type of furnace for practicing the present invention, although the invention can also be applied to other existing types of high temperature furnaces.

The present invention relates to a method for the heat treatment of material at high temperatures, where the material from which the bottom of the furnace chamber is made forms a eutectic with the material to be heat-treated at a temperature which is lower than the heat treatment temperature.

Figure 2:
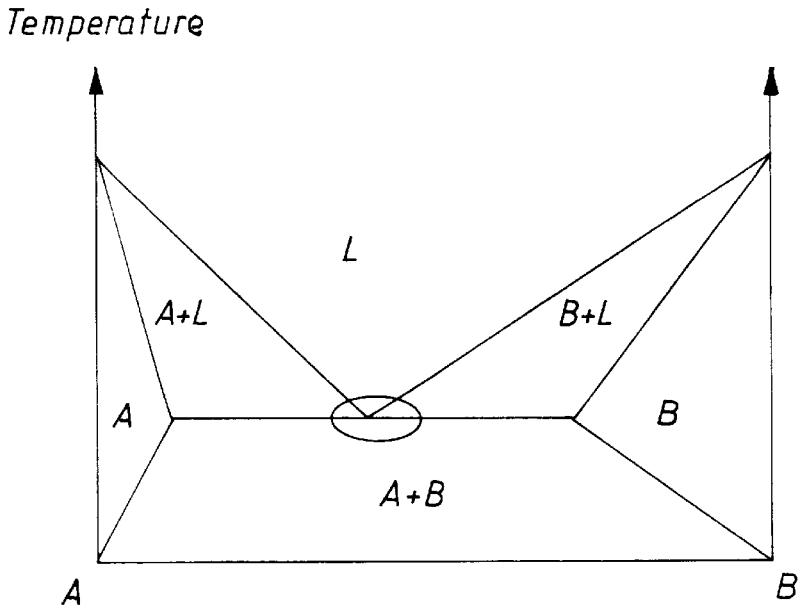
FIG. 2 is a phase diagram between two materials.

FIG. 2 is a schematic phase diagram between the substances A and B, where L signifies a liquid phase. The encircled area includes a eutectic, i.e. the lowest temperature at which the substances A and B will assume a liquid phase when brought together. It is this temperature that constitutes the aforesaid limiting heat-treatment temperature.

According to the invention, a part 20 of the bottom 19 of the furnace chamber, said part comprising the whole or a portion of the furnace chamber bottom, on which the material to be heat-treated rests, is formed at least in part of a material that has the same chemical composition as or a similar chemical composition to, the chemical composition of the material to be heat-treated.

The bottom part 20 is placed so as not to be in physical contact with other furnace lining material in the furnace chamber 15. Furthermore, the bottom part 20 of the furnace construction is disposed at a location such that the position of contact 21 between the bottom part 20 and the beams and columns 10 at which the bottom part 20 is arranged, is adapted to attain during the heat treatment process a temperature which is below the temperature at which a molten phase is formed between the materials that are in contact with each other at the contact position 21. The bottom part 20 may comprise a monocrystalline or polycrystalline material.

According to one highly preferred embodiment, that portion of the bottom part 20 which consists of a material having the same chemical composition as, or a chemical composition similar to, the material to be heat-treated, is given the form of a body 22 whose upper surface 23 is located at a level above the remaining portion 19 of the furnace chamber bottom and which extends through a hole 24 in said remaining part of the furnace bottom. A gap 25 is present between the body 22 and the hole 24. The bottom surface 26 of said body is caused to rest on a part of the furnace construction that is located beneath the remaining portion of the furnace bottom 19.

According to one preferred embodiment, the body 22 is a layered body, as shown in FIG. 1. The body 22 includes a plug 27, support legs 28 and a plate 29. In this embodiment, at least the upper part of the body, i.e. the plate 29, is made of a material that has the same chemical composition as, or a chemical composition similar to, the material to be heat-treated. The support legs 28 may be formed from monocrystalline or polycrystalline aluminium oxide, for instance. The plug 27 is suitably comprised of a high-temperature insulating material, such as a material based on aluminium oxide.

According to another preferred embodiment, the uppermost part of said body 22 forms a crucible 30. The plate 29 and the crucible 30 are made of the same material and thus have the same chemical composition as, or a chemical composition similar to, the material to be heat-treated.

Figure 3:
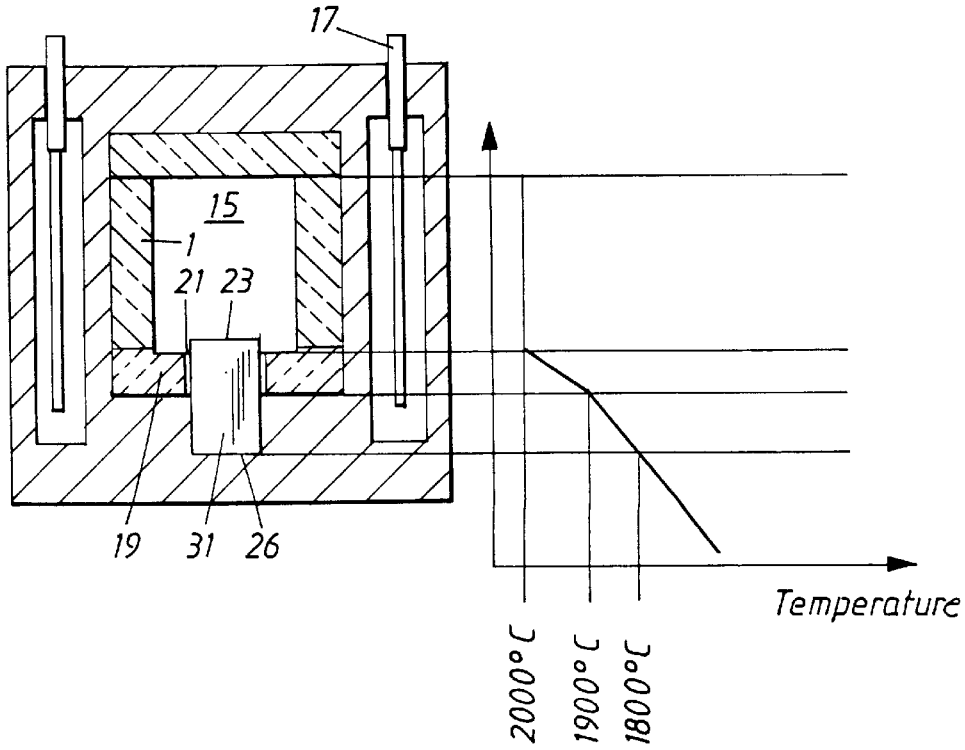
FIG. 3 is a schematic, vertical sectioned view of a furnace in which a second embodiment of the invention is shown.

According to another embodiment, shown in FIG. 3, the body 31 is an homogenous body. Although not shown, the body 31 may also include a crucible standing thereon.

Irrespective of the embodiment in other respects, it is preferred that said body 31 has the form of a pillar.

It was mentioned in the introduction that aluminium oxide cannot be heat-treated at 2000° C. when the furnace chamber is comprised of zirconium dioxide, magnesium oxide or calcium oxide. $Al_2O_3$—MgO forms a eutectic at 1995° C., CaO—$Al_2O_3$ forms a eutectic at about 1600° C., and $ZrO_2$—$Al_2O_3$ forms a eutectic at 1845° C.

However, the present invention makes such heat treatment possible. With regard to aluminium oxide, there is used a body 22, 31 formed from of monocrystalline or polycrystalline aluminium oxide, meaning that $Al_2O_3$ meets $Al_2O_3$ at the point of contact between the body 22, 31 and the material to be heat-treated. The furnace chamber has a temperature of 2000° C., as illustrated in FIG. 3. Pure aluminium oxide forms a molten phase at 2050° C. The temperature immediately beneath the furnace floor 19 is, e.g., 1900° C., see FIG. 3. The body 22, 31 has no physical contact with the floor 19 of the furnace chamber, because of the presence of the gap 21. The temperature of the bottom surface 26 of the body is, e.g., 1800° C. This lies against the furnace material and consequently the temperature should be below the temperature at which a eutectic will form between the material of said body and the furnace material shall be taken into account.

Thus, the furnace space and the furnace construction may be comprised of MgO, since $Al_2O_3$—MgO have a melt eutectic at 1995° C., which is higher than 1800° C. $ZrO_2$ can also be used, since $ZrO_2$—$Al_2O_3$ form a eutectic at 1845° C.

When using CaO as the furnace material, the body 22, 31 must extend further down in the furnace construction, where the temperature is lower than the temperature at which CaO—$Al_2O_3$ form a eutectic, namely at a temperature of about 1600° C.

It will be evident that the present invention enables different materials to be heat-treated at very high temperatures.

It will also be evident that different material combinations between furnace chamber lining material, body material, the material against which the bottom side of the body rests, and the material to be heat-treated can exist when practicing the present invention. The person skilled in this art will be capable of choosing material combinations which will not form a melt during the heat-treatment process.

Various material combinations and various types of furnaces have been mentioned in the aforegoing. However, the invention is not restricted to these material combinations or furnaces. It will therefore be understood that the invention is not restricted to the aforedescribed exemplifying embodiments thereof, and that variations can be made within the scope of the following Claims.

What is claimed is:

1. A method for heat-treating material at high temperatures within a furnace chamber having a furnace chamber sidewall and a furnace chamber bottom each formed from an oxidic material, where the material from which the furnace chamber bottom is made forms a eutectic with the material to be heat-treated at a temperature lower than a desired heat treatment temperature, said method comprising the steps of: providing a material support member adjacent the furnace chamber bottom, wherein the material support member is formed from a material that has a chemical composition similar to that of the material to be heat treated so that the material support member does not form a eutectic with the material to be heat-treated when the material support member and the material to be heat treated are each heated to a heat treatment temperature that is below the melt temperature of the material to be heat treated; positioning said material support member so that it has no physical contact with the furnace chamber bottom; and placing the material support member in the furnace chamber at a position such that a contact position between said material support member and a furnace support member formed from furnace lining material will attain during a heat-treatment process a temperature which is lower than a temperature at which a molten phase will be formed between materials that are in contact with one another at said contact location.

2. A method according to claim 1, including the steps of: forming the material support member in the form of a body having an upper surface that is located at a level above the furnace chamber bottom; providing an opening in said furnace chamber bottom; placing the body in the opening so that a gap is present between said body and said opening; and positioning a bottom surface of said body on a surface that is located beneath said furnace bottom.

3. A method according to claim 2, wherein said body is homogenous.

4. A method according to claim 2, wherein the body is a layered body where at least an upper part is formed from a material that does not form a eutectic with the material to be heat treated.

5. A method according to claim 2, wherein an uppermost part of said body is a crucible.

6. A furnace chamber for high temperature furnaces for the heat treatment of material without melting of the material to be heat treated, wherein the material from which the furnace chamber bottom is made forms a having lowest melting point possible eutectic with the material to be heat-treated at a temperature lower than a desired heat treatment temperature, said furnace chamber bottom comprising: a material support member that is adjacent the furnace chamber bottom and on which a material to be heat-treated is received, wherein the material support member is formed at least in part of a material that has a chemical composition similar to that of the material to be heat treated so that the material support member does not form a eutectic with the material to be heat-treated when the material support member and the material to be heat treated are each heated to a heat treatment temperature that is below the melt temperature of the material to be heat treated; the material support member having no physical contact with the furnace chamber bottom material and disposed in the furnace such that a contact position between said material support member and a furnace support member formed from furnace lining material attains during a heat-treatment process a temperature which is lower than a temperature at which materials that are mutually in contact at said contact position will form a molten phase.

7. A furnace bottom construction according to claim 6, wherein said material support member has the form of a body having an upper surface located above an upper surface of the furnace chamber bottom, wherein the furnace chamber bottom includes an opening and wherein said body extends through the opening in the furnace chamber bottom and a gap is present between the body and the opening; and wherein a bottom surface of the body rests on a part of the furnace support member that is located beneath the furnace bottom.

8. A furnace bottom construction according to claim 7, wherein the body is homogenous.

9. A furnace bottom construction according to claim 7, wherein the body is a multiple-component body, where at least an upper part of the body is made of a material that has the same chemical composition as or a chemical composition similar to the material to be heat-treated.

10. A furnace bottom constriction according to claim 7, wherein an uppermost part of said body is a crucible.

11. A method according to claim 1 wherein the material support member is made from the same material as the material to be heat treated.

12. A method according to claim 1 wherein the material to be heat treated is aluminum oxide.

13. A method according to claim 12, wherein the furnace lining material is selected from the group consisting of zirconium dioxide, magnesium oxide, calcium oxide, and mixtures thereof.

14. A furnace bottom construction according to claim 6 wherein the material support member is made from the same material as the material to be heat treated.

15. A furnace bottom construction according to claim 6 wherein the material to be heat treated is aluminum oxide.

16. A furnace bottom construction according to claim 15, wherein the furnace lining material is selected from the group consisting of zirconium dioxide, magnesium oxide, calcium oxide, and mixtures thereof.

17. A method in accordance with claim 1 wherein the material support member has the same chemical composition as that of the material to be heat treated.

18. A furnace bottom construction in accordance with claim 6 wherein the material support member has the same chemical composition as that of the material to be heat treated.

19. A method in accordance with claim 1 wherein the material to be heat treated is an aluminum oxide, and the material support member is made from a material selected from the group consisting of monocrystalline aluminum oxides, polycrystalline aluminum oxides, and mixtures thereof.

20. A furnace bottom construction in accordance with claim 6 wherein the material to be heat treated is an aluminum oxide, and the material support member is made from a material selected from the group consisting of monocrystalline aluminum oxides, polycrystalline aluminum oxides, and mixtures thereof.

* * * * *